US011425927B2

(12) United States Patent
Skierczynski et al.

(10) Patent No.: US 11,425,927 B2
(45) Date of Patent: Aug. 30, 2022

(54) METHOD FOR REDUCING STRESS OF A GARNITURE BELT IN A TOBACCO INDUSTRY MACHINE, A METHOD FOR REDUCING REJECTION IN A TOBACCO INDUSTRY MACHINE AND A GARNITURE DEVICE FOR A TOBACCO INDUSTRY MACHINE

(71) Applicant: International Tobacco Machinery Poland Sp. z o.o., Radom (PL)

(72) Inventors: Robert Skierczynski, Radom (PL); Miroslaw Zajac, Radom (PL)

(73) Assignee: INTERNATIONAL TOBACCO MACHINERY POLAND Sp. z.o.o., Radom (PL)

( * ) Notice: Subject to any disclaimer, the term of this patent is extended or adjusted under 35 U.S.C. 154(b) by 0 days.

(21) Appl. No.: 16/490,532

(22) PCT Filed: Feb. 25, 2018

(86) PCT No.: PCT/EP2018/054604
§ 371 (c)(1),
(2) Date: Jan. 28, 2020

(87) PCT Pub. No.: WO2018/158167
PCT Pub. Date: Sep. 7, 2018

(65) Prior Publication Data

US 2020/0315242 A1 Oct. 8, 2020

(30) Foreign Application Priority Data

Mar. 2, 2017 (PL) ..... P.420702

(51) Int. Cl.
*A24C 5/18* (2006.01)
*A24C 5/24* (2006.01)
(Continued)

(52) U.S. Cl.
CPC ..... *A24C 5/1857* (2013.01); *A24C 5/1807* (2013.01); *A24C 5/24* (2013.01);
(Continued)

(58) Field of Classification Search
CPC ..... A24C 5/1857; A24C 5/18
See application file for complete search history.

(56) References Cited

U.S. PATENT DOCUMENTS 3,380,352 A 4/1968 Garton
3,563,249 A * 2/1971 Geyer ..... A24C 5/18 131/84.3
4,889,143 A * 12/1989 Pryor ..... A24C 5/1828 131/331

FOREIGN PATENT DOCUMENTS

EP 0569817 11/1993
EP 0569817 B1 11/1993
(Continued)

OTHER PUBLICATIONS

Schafforz et al., "Format device of a strand machine", Machine translation relied upon (Year: 2012).*
(Continued)

*Primary Examiner* — Niki Bakhtiari
*Assistant Examiner* — Stephanie Lynn Moore
(74) *Attorney, Agent, or Firm* — Soody Tronson; STLG

(57) ABSTRACT

A method for reducing stress of a garniture belt in a tobacco industry machine for manufacturing rods from a continuous rod comprising a garniture belt, guiding bars configured for guiding the garniture belt, a filling material receiving section, a rod diameter setting section, and a rod stabilizing section, the method comprising adjusting a resistance of motion of the garniture belt in at least one of the filling material receiving section or the rod stabilizing section by adjusting a width of the garniture channel by changing
(Continued)

positions of the guiding bars in the horizontal direction perpendicular to a longitudinal axis of the garniture channel.

19 Claims, 8 Drawing Sheets

(51) Int. Cl.
*A24C 5/28* (2006.01)
*A24C 5/34* (2006.01)
*A24D 3/02* (2006.01)

(52) U.S. Cl.
CPC ..... *A24C 5/28* (2013.01); *A24C 5/34* (2013.01); *A24D 3/0233* (2013.01)

(56) References Cited

FOREIGN PATENT DOCUMENTS

| | | | | |
|---|---|---|---|---|
| EP | 2641483 | A1 * | 9/2013 | ..... A24D 3/0233 |
| EP | 2641483 | A1 | 9/2013 | |
| EP | 2666 372 | A2 | 11/2013 | |
| EP | 2666372 | A2 | 11/2013 | |
| GB | 276165 | | 8/1927 | |

OTHER PUBLICATIONS

PCT/EP2018/054604 International Search Report and Written Opinion of the International Searching Authority.
EP Search Report in international application No. PCT/EP2018/054604.

* cited by examiner

D - D

E - E

METHOD FOR REDUCING STRESS OF A GARNITURE BELT IN A TOBACCO INDUSTRY MACHINE, A METHOD FOR REDUCING REJECTION IN A TOBACCO INDUSTRY MACHINE AND A GARNITURE DEVICE FOR A TOBACCO INDUSTRY MACHINE

TECHNICAL FIELD

The present disclosure relates to a method for reducing stress of a garniture belt in a tobacco industry machine, a method for reducing rejection in a tobacco industry machine and a garniture device for a tobacco industry machine.

BACKGROUND

Tobacco industry products are usually manufactured in a continuous process by forming a continuous filled rod, which is cut into single rod-like elements. This process allows to manufacture products such as tobacco rods comprising shredded tobacco or tobacco foil, filter rods formed from one type of filtering material (usually fibrous material, for example acetate) or filter rods formed from at least two different fibrous or non-fibrous filtering materials in a form of cylindrical segments. The continuous rods are formed by wrapping a filling material into a wrapper such as a wrapping paper, a nonwoven fabric or a foil. In machines for manufacturing rod-like elements, the filling material is fed onto a longitudinally moving wrapper, which constitutes an outer wrapper of the continuous rod. Forming of the continuous rod is presented i.a. in documents EP0879564A1 and EP1293136A1.

SUMMARY

There is disclosed a method for reducing stress of a garniture belt in a tobacco industry machine for manufacturing rods from a continuous rod comprising a filling material wrapped by a wrapper, the continuous rod being formed on the garniture belt being driven in a garniture channel of a garniture device, wherein the garniture device comprises a filling material receiving section, a rod diameter setting section and a rod stabilizing section, wherein the machine comprises at least one feeding unit for feeding the filling material onto the wrapper being transported on the garniture belt, a glue feeding unit, a cutting head for cutting the continuous rod into the rods, the method comprising adjusting a resistance of motion of the garniture belt by: reducing the resistance of motion of the garniture belt in the filling material receiving section by adjusting positions of guiding bars for guiding the garniture belt so that a width of the garniture channel in the filling material receiving section is greater than a width of the garniture channel in the rod diameter setting section, and/or reducing the resistance of motion of the garniture belt in the rod stabilizing section by adjusting positions of guiding bars for guiding the garniture belt so that a width of the garniture channel in the rod stabilizing section is greater than the width of the garniture channel in the rod diameter setting section.

The method may further comprise measuring a stress of the garniture belt and adjusting the resistance of motion of the garniture belt after detecting a stress which is greater than an expected stress threshold.

The method may further comprise checking a length of the manufactured rod and rejecting the rods having inappropriate length, measuring a rejection level caused by the inappropriate length of the rod and adjusting the resistance of motion of the garniture belt after detecting the rejection level which is greater than allowable.

The method may further comprise setting the positions of the guiding bars for guiding the garniture belt in the filling material receiving section so that the guiding bars are convergent in the direction of movement of the garniture belt.

The method may further comprise setting the positions of the guiding bars for guiding the garniture belt in the filling material receiving section so that the guiding bars are in parallel with respect to each other.

The method may further comprise setting the positions of the guiding bars for guiding the garniture belt in the rod stabilizing section so that the guiding bars are divergent in the direction of movement of the garniture belt.

The method may further comprise setting the positions of the guiding bars for guiding the garniture belt in the rod stabilizing section so that the guiding bars are in parallel with respect to each other.

The filling material may be a filtering material.

The filling material may have a form of segments.

The filling material may have a form of segments and of a loose material.

The filling material may be a tobacco material.

There is also disclosed a garniture device for a tobacco industry machine for manufacturing rods from a continuous rod comprising a filling material wrapped by a wrapper, the continuous rod being formed on the garniture belt being driven in a garniture channel of the garniture device, wherein the garniture device comprises a filling material receiving section, a rod diameter setting section and a rod stabilizing section, and wherein the machine comprises at least one feeding unit for feeding the filling material onto the wrapper which is transported on the garniture belt, a glue feeding unit for feeding the glue on the edge of the wrapper and a cutting head for cutting the continuous rod into rods, wherein the garniture belt is guided by guiding bars and the device further comprises at least one driving element for changing positions of the guiding bars to adjust a width of the garniture channel.

The driving element may be a mechanical device.

The driving element may be an electrical device.

The driving element may be an electromagnetic device.

The driving element may be a pneumatic device.

The device may further comprise encoders, mounted on rolls for measuring an angular position of the rolls.

The device may further comprise a tensile stress sensor located on a roll for detecting the stress of the garniture belt.

The garniture belt may be driven by a driving wheel and is guided by an inlet roll located at the beginning of the filling material receiving section and by an outlet roll located at the end of the stabilizing section along the garniture channel, so that the garniture belt is driven along the garniture channel from the inlet roll towards the outlet roll.

Owing to reduction of tensile stress of the garniture belt in the garniture device, an unexpected effect of a decrease of rejection of rod-like elements during production is achieved, in particular the rejection caused by inappropriate length of rod-like elements. Moreover, the durability of the garniture belt is increased while a driving torque of the garniture belt is reduced.

Owing to the device presented herein, the time of adjustment of positions of garniture bars is very short and the adjustment is not dependent on experience of a person making the adjustment.

BRIEF DESCRIPTION OF FIGURES

The present disclosure is presented by means of example embodiments in a drawing, in which.

DETAILED DESCRIPTION

Figure 1:
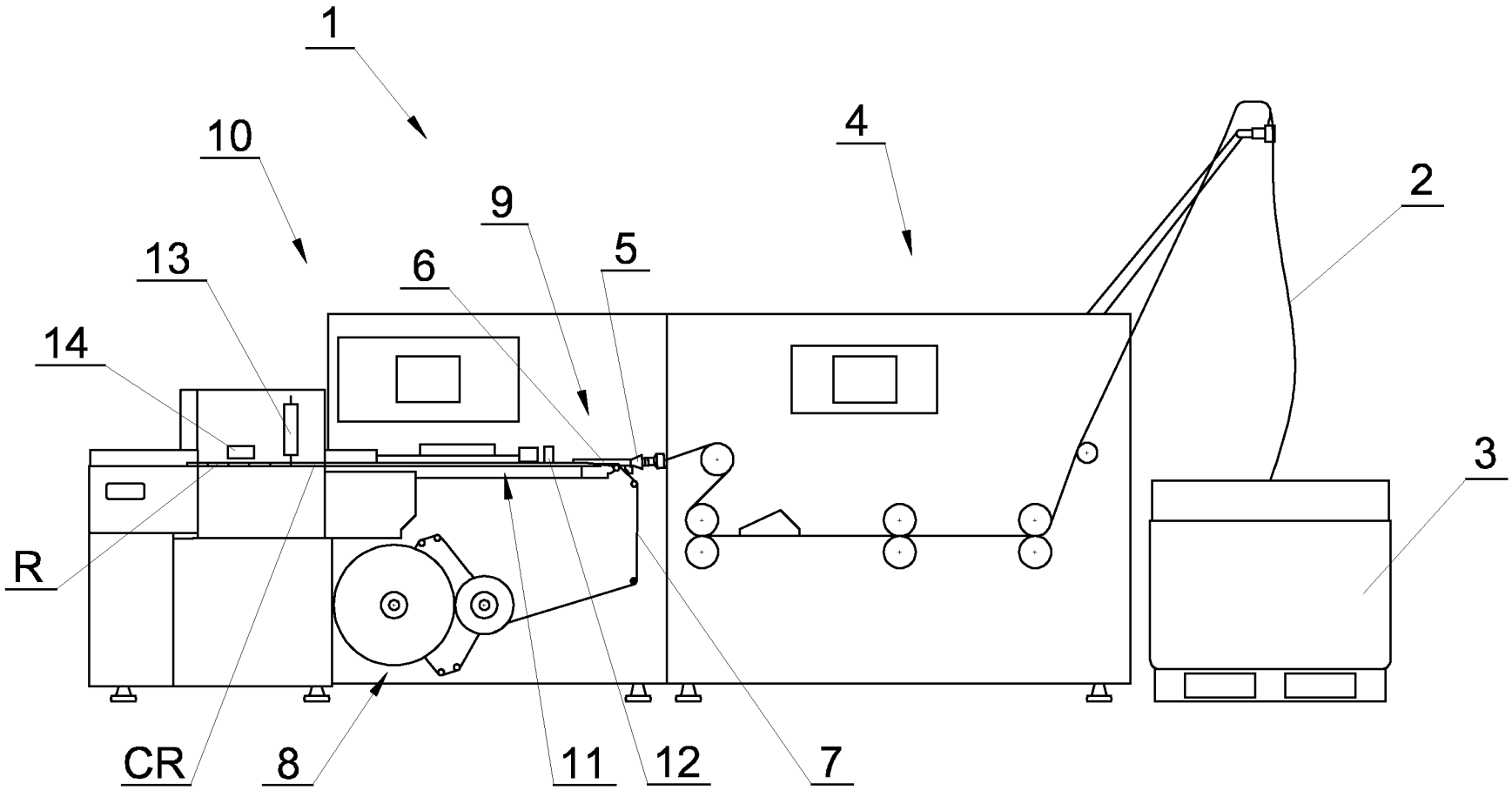
FIG. 1 shows a view of a machine for manufacturing filter rods.

FIG. 1 shows schematically a filter machine 1 for manufacturing filter rods R. The filter machine 1 comprises a preparation unit 4, which prepares a filtering material for filling the manufactured filter rods, and a garniture unit 10 on which a continuous rod is produced and cut into single filter rods R. The fibers of the filtering material, for example acetate fibers in a form of a band that forms the filtering material 2, may be fed from a container in a form of a bale 3. The fibers of the filtering material 2 may be compressed in the bale 3. The fibers of the filtering material band 2 are stretched and loosened by means of compressed air and cylinders of the fibrous band preparation unit 4 for preparing the filtering material band 2. As a result of stretching and loosening, the fibers of the filtering material band 2 detach from each other and may accommodate more air in between. In the preparation unit 4, the fibers may be soaked with a softening fluid (for example, triacetin). The machine 1 for manufacturing filter rods R has an inserting element 5 in a form of a funnel, through which the band of the filtering material 2 is passed from the preparation unit 4. While the band of the filtering material 2 passes through the inserting element 5, the fibers are initially compacted. The inserting element 5 is followed by a guiding element 6 having a longitudinal channel for guiding the filtering material band 2, wherein the band 2 is initially formed to a continuous rod. The formed rod will be wrapper by a wrapper 7 fed from a feeding unit 8. The guiding element 6 is a part of an assembly 9 for feeding a filling material to a garniture device 11, on which the filling material is wrapped by the wrapper 7 in order to form a continuous filter rod CR. The garniture device 11 has a form of a transporter equipped with a garniture belt, on which the wrapper 7 together with the filling material are placed. Above the garniture device, a glue feeding unit 12 is located, for example a glue nozzle. The filter machine 1 also comprises a rotational cutting head 13 for cutting the formed continuous filter rod CR into single filter rods R. The filter machine 1 has a measuring unit 14, 14A for checking the quality of the manufactured rods, located on the filter machine 1. The rods having at least one parameter which is not in accordance with specified nominal parameters are treated as defective. The parameters to be checked may be the diameter of the rod, the length of the rod, the filling density of the rod etc., wherein for particular nominal values of the parameters, tolerance zones are specified. The rod is rejected when the measured parameter is outside the specified tolerance zone. The rods manufactured on the filter machine, are placed in flutes of a drum transporter, and are transported further by means of consecutive drum transporters. One of the drum transporters may be equipped with the rejection devices for rejecting the defective rods by means of a compressed air stream, wherein the stream rejects the defective rods out of the transporter flutes, wherein the rejection may be performed transversally or longitudinally with respect to the flutes as described in a document GB2043962. The measuring unit may be located outside the filter machine as a separate unit, and in such case the measurements are performed on the rods which are received from a mass flow, while the defective rods are rejected from the production.

Figure 2:
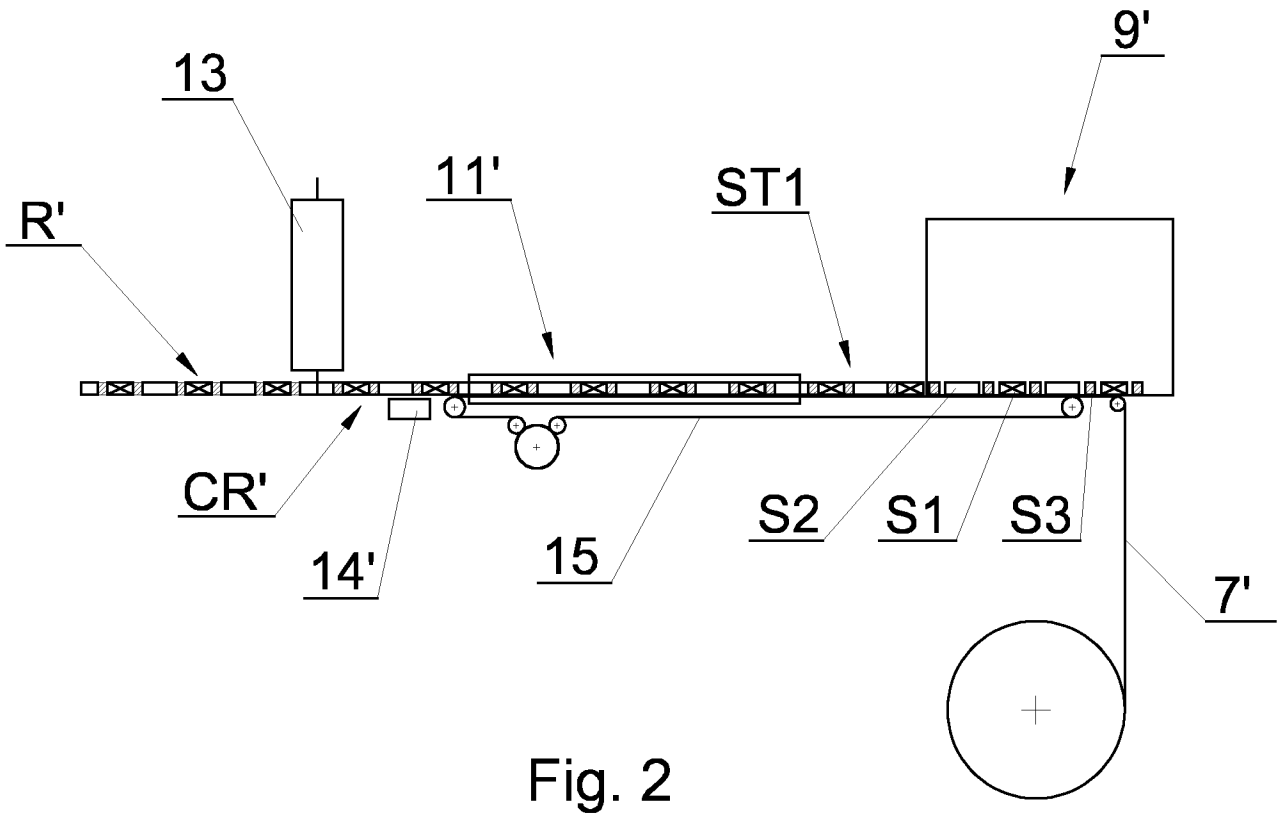
FIG. 2 shows a fragment of a machine for manufacturing multi-segment filter rods.

FIG. 2 shows a fragment of a machine for manufacturing multi-segment rod-like elements. The machine for manufacturing multi-segment rod-like elements comprises an assembly 9' for feeding a filling material in a form of segments S1, S2, S3. The cylindrical segments S1, S2, S3 move in a train ST1, wherein the segments may be pushed together or may be distanced. The distances between the neighboring segments may be filled with a loose material, for example charcoal granulate or other filtering loose material. The train ST1 is fed onto a wrapper 7' moving on a garniture belt 15 of a garniture device 11'. The formed, continuous, rod CR' is cut by means of a cutting head 13' into single rod-like elements—multi-segment rods R', in particular the multi-segment filtering rods. The machine for manufacturing multi-segment rod-like elements may also comprise a measuring unit 14' for checking the quality of the rods manufactured on the machine. The rods having at least one parameter which is not in accordance with specified nominal parameters are treated as defective. The parameters to be checked may be the diameter of the rod, the length of the rod, the length of the segments, the distances between the segments etc., wherein for particular nominal values of the parameters, tolerance zones are specified. The rod is rejected when the measured parameter is outside the specified tolerance zone. Analogously as in the case of the abovementioned filter rods, the manufactured multi-segment rods are placed and transported further by means of consecutive drum transporters, from where the defective rods are rejected. Similarly, the measuring unit may be located outside the filter machine as a separate unit, and then the received rods are measured beyond the rods flow.

Figure 3:
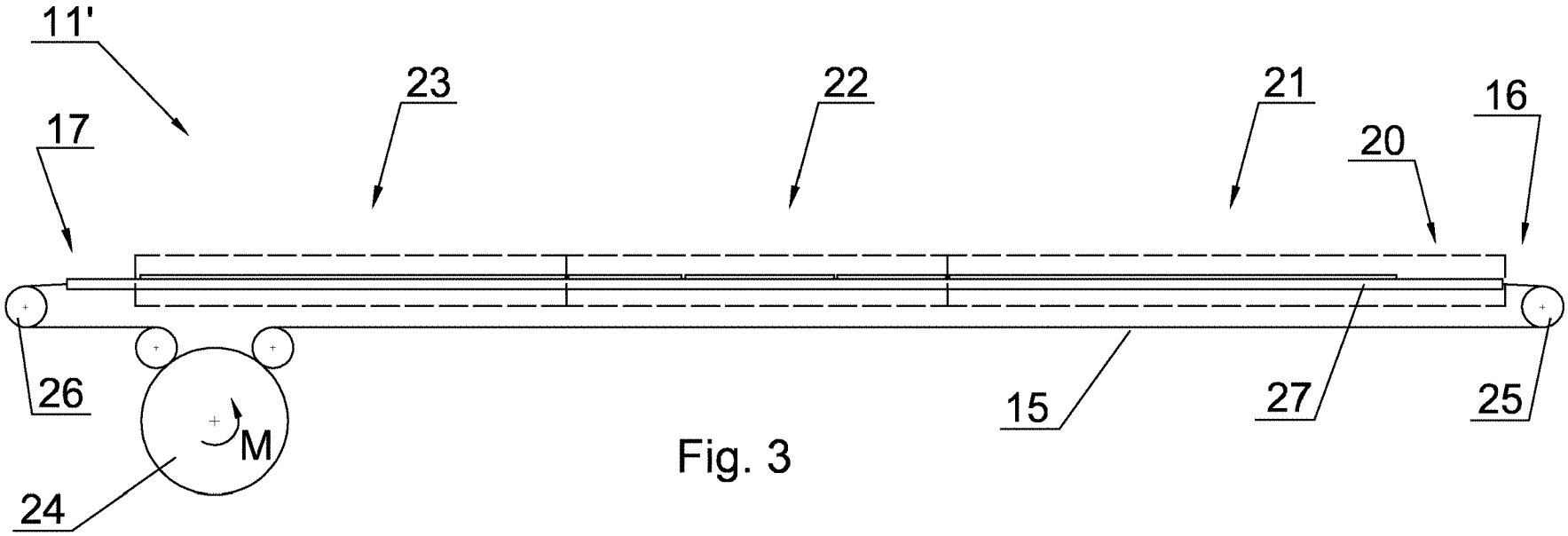
FIG. 3 shows a garniture device in a side view.
Figure 4:
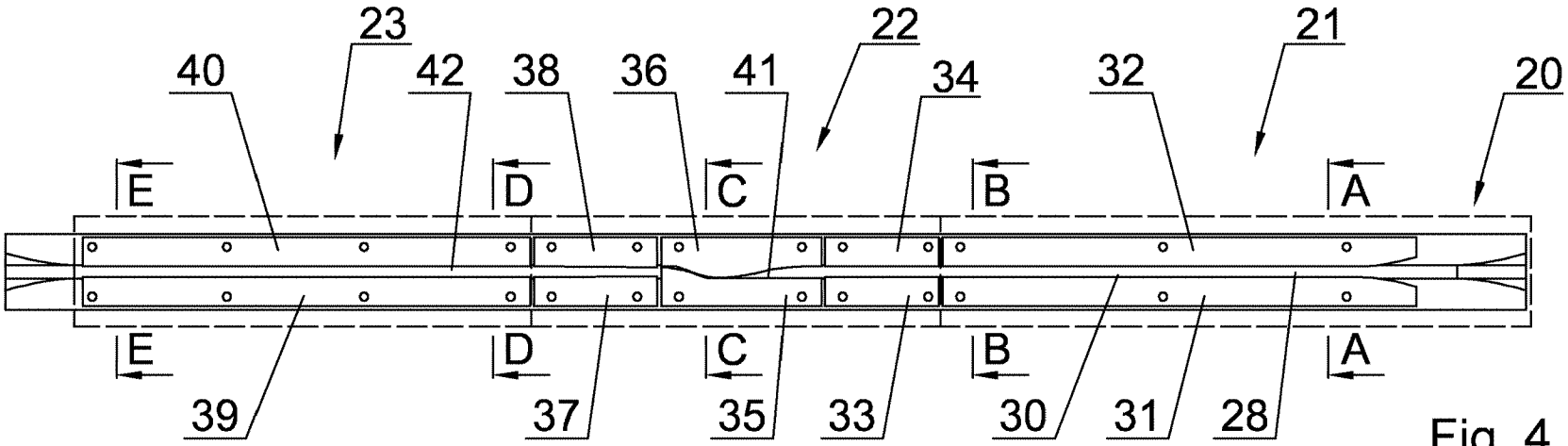
FIG. 4 shows the garniture device without a garniture belt in a top view.

The garniture device presented in FIG. 3 and FIG. 4 comprises three sections: a receiving section 21 for receiving the filling material, a setting section 22 for setting the rod diameter and a stabilizing section 23 for stabilizing the rod. The filling material receiving section 21 encompasses the segment from an inlet 16 of the garniture device up to the rod diameter setting section 22. Alongside the garniture device is located a garniture channel 30, which at the filling material receiving section is opened from the top. The garniture belt 15 is driven along the garniture channel 30. The rod diameter setting section 22 encompasses the segment of the garniture channel 30 in which glue is applied on one of the edges of the wrapper 7', wherein the edges of the wrapper 7' are folded by means of the folding elements located at the sides and at the top of the garniture channel 30 such that the wrapper 7' is formed as a continuous cylindrical sheath for the filling material which forms the continuous rod CR'. The rod stabilizing section 23 begins after the rod diameter setting section 22, it means in the location where the edges of the wrapper are already closed, i.e. the wrapper is at its predefined position and forms the cover for the filling material, while the glue applied for gluing the edges of the wrapper has not achieved its strength yet. In the rod stabilizing section 23, the glued seam is cooled down or heated up, depending on the type of the applied glue. The lengths of particular sections 21, 22, 23 are dependent on the parameters of the manufactured rod-like elements, and may vary.

Figure 5:
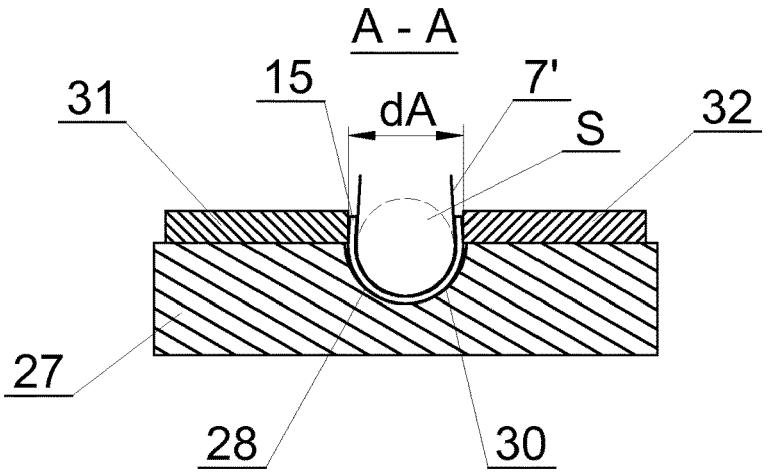
FIGS. 5, 6, 7, 8 and 9 show cross-sections through the sections of the garniture device.
Figure 6:
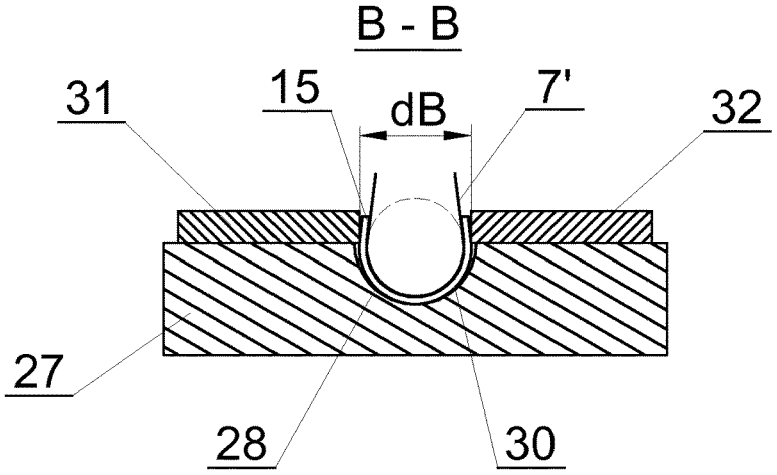

The garniture belt 15 of the garniture device 11' is driven by a driving wheel 24 (FIG. 3) to which a driving torque M is applied. The garniture belt 15 is wound around an inlet roll 25 and an outlet roll 26, wherein the garniture belt 15 is driven along the garniture channel 30 through all the three sections 21, 22, 23 and moves from the right to the left side of the drawing. The filling material in the form of the continuous rod of the fibrous material 2 on the filter machine 1 shown in FIG. 1, as well as in the form of the train ST1 on the machine shown in FIG. 2, is placed in the filling material receiving section 21. The filling material receiving section 21 encompasses a base garniture bar 27, in which a groove 28 is made, which constitutes the first section of the garniture channel 30 (FIG. 4). The base garniture bar 27, shown in FIG. 3, is formed as a single element but may also be formed from several elements. Guiding bars 31 and 32 for adjusting the width of the garniture channel 30 may be mounted to the base garniture bar 27 in the region of the filling material receiving section 21. The position of the guiding bars 31 and 32, being in contact with the garniture belt 15 may be changed owing to which the effective width of the garniture channel 30 may be adjusted. In FIG. 4, two cross-sections A-A and B-B through the filling material receiving section 21, are depicted. A width dA, depicted in the cross-section A-A in FIG. 5, of the garniture channel 30 in the filling material receiving section 21 at the side of the inlet 16, may be equal to a width dB, depicted in the cross-section B-B in FIG. 6, of the garniture channel 30 at the side of the rod diameter setting section 22 or may be greater than the width dB, it means that the garniture channel 30 in the receiving section may have constant width or may be convergent in the direction of the movement of the garniture belt 15. The filling material receiving section 21 comprises a zone 20 without guiding bars, wherein in the FIG. 3 and FIG. 4 the zone 29 is shortened with respect to the actual length. Its actual length is dependent on the method of feeding and construction of the device for feeding the filling material.

Figure 7:
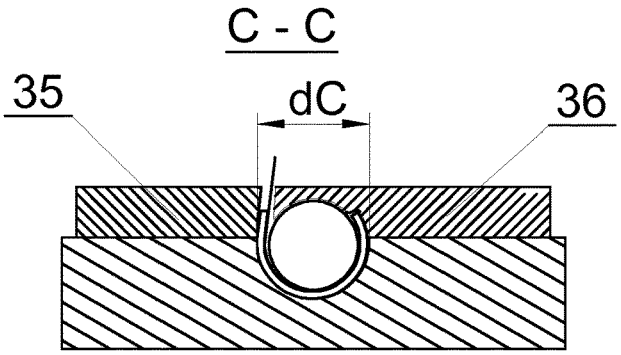

The rod diameter setting section 22 comprises folding elements 35 and 36, which together with a channel 41 in the base garniture bar 27 form the second section of the garniture channel 30. The rod diameter setting section 22 may be additionally equipped with guiding bars 33 and 34 located in front of the folding elements 35 and 36 and may be equipped with guiding bars 37 and 38 located behind the folding elements 35 and 36. The position of the bars 33, 34, 37 and 38 may be adjusted independently on the folding elements 35 and 36. The guiding bars 34 and 38 may be integrated with the folding element 36 forming a single guiding folding bar. The guiding bars 33 and 37 may be integrated with the folding element 35 forming a single guiding folding bar. The guiding bar 33 may be integrated with the guiding bar 31, whereas the bar 34 may be integrated with the bar 32. Analogously the guiding bar 37 may be integrated with the guiding bar 39, whereas the bar 38 may be integrated with the bar 40. A width dC of the garniture channel 30 in the rod diameter setting section 22 is depicted in the cross-section C-C from FIG. 4 shown in FIG. 7. The width dC may be smaller or equal to the width dA and dB in the filling material receiving section 21.

Figure 8:
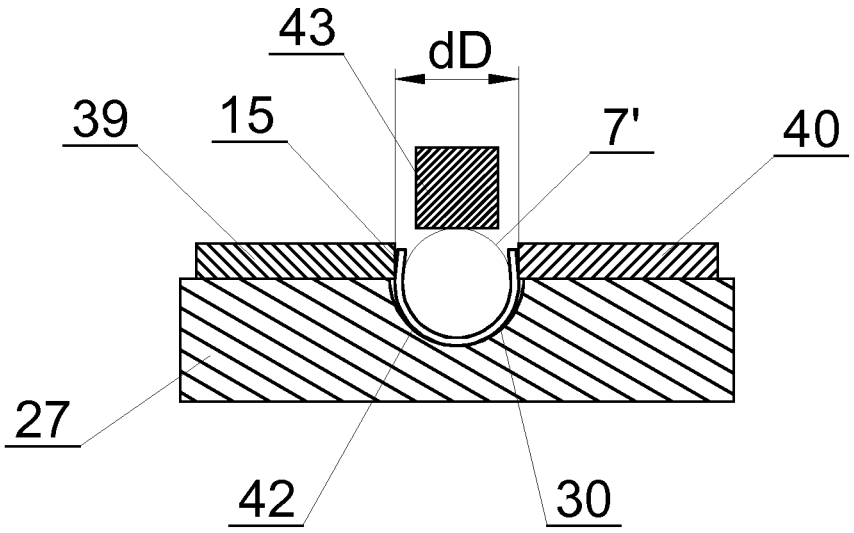
Figure 9:
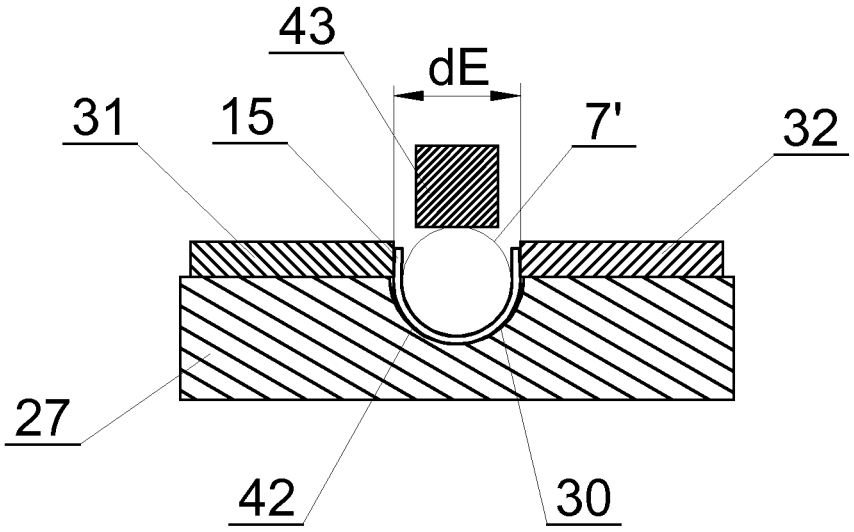

The rod stabilizing section 23 has a groove 42 in the base garniture bar 27. Guiding bars 39 and 40 for adjusting the width of the garniture channel 30, may be mounted to the base garniture bar 27 in the rod stabilizing section 23. The position of the guiding bars 39 and 40 being in contact with the garniture belt 15 may be changed and owing to this the effective width of the garniture channel 30 may be adjusted. Two cross-sections D-D and E-E through the rod stabilizing section 23 are depicted in FIG. 4. A width dD of the garniture channel 30 in the rod stabilizing section 23 at the side of the rod diameter setting section 22 is depicted in the cross-section D-D in FIG. 8 and may be equal to a width dE of the garniture channel 30 at the side of an outlet 17 from the garniture device 11' which is depicted in the cross-section E-E in FIG. 9 or may be smaller than the width dE, which means that in the rod stabilizing section 23, the garniture channel 30 may have a constant width or may be divergent in the direction of the movement of the garniture belt 15. In the rod stabilizing section 23 the garniture channel 30 may be equipped with a heating or cooling bar 43, depending on the applied glue.

During operation of the machine for manufacturing the rod-like elements, the garniture belt in the garniture device 11, 11' is subjected to tensile stress. In the filling material receiving section 21, the filling material is compressed because the filling material has to be maintained inside the wrapper. In the rod diameter setting section 22 the rod is formed, the wrapper is firmly pressed towards the filling material in order to achieve a constant diameter and smooth surface of the rod. In the rod stabilizing section 23, the formed continuous rod CR' is compressed until the sufficient binding force of the glue is achieved. The garniture belt 15 is subjected to load on the entire length of the garniture channel 30. The friction force causes the increase of motion resistance of the garniture belt 15 and causes a constant increase of tensile stress on the length of the garniture channel 30, wherein the highest increase occurs in the rod diameter setting section 22.

Figure 10:
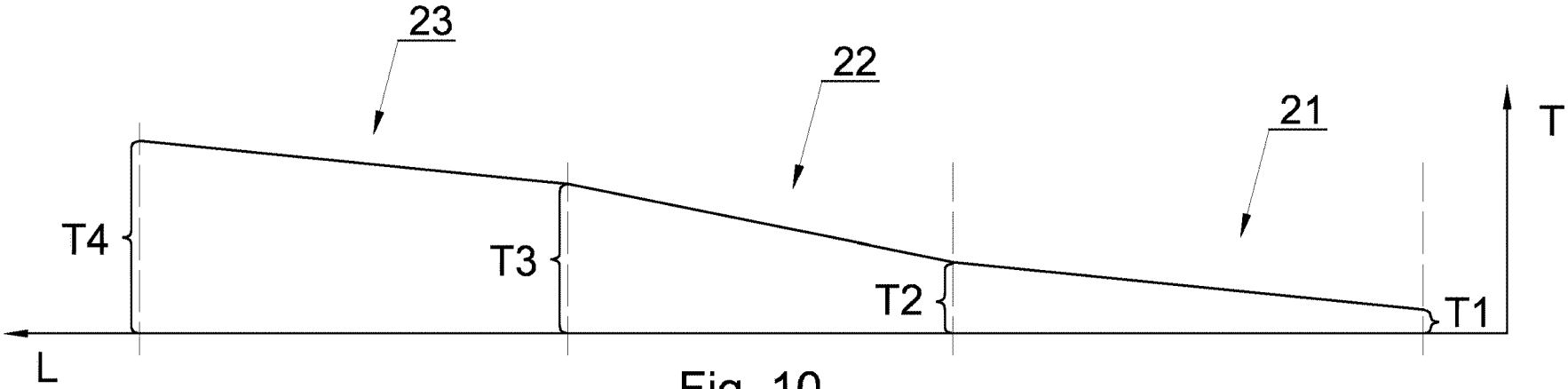
FIGS. 10 and 11 show a diagram of tensile stress of the garniture belt.

FIG. 10 shows a diagram of tensile stress T in the garniture belt 15 along the direction of movement of the garniture belt 15 in the garniture channel 30 depending on the distance L from the inlet 16 to the garniture device in case when a constant width of the garniture channel 30 is set. T1 denotes tensile stress of the garniture belt 15 at the inlet 16 to the garniture channel 30, which are present in the garniture belt 15 due to the necessity of tensioning the garniture belt 15 between the driving wheel 24 and the inlet roll 25. Due to the motion resistance of the garniture belt 15 in the filling material receiving section 21, the tensile stress increases to a value T2 at the end of the filling material receiving section 21. In the rod diameter setting section 22 the value of the tensile stress of the garniture belt increases to the value T3 at the end of the setting section. Due to locating of the folding elements 35 and 36, in this section, which interact with the entire outer surface of the formed rod, the increase of the stress of the rod diameter setting section 22 in reality may be non-linear, and moreover the stress may rise in a greater degree than in the filling material receiving section 21. In the rod stabilizing section 23 the tensile stress rises from the value T3 to a value T4 at the end of the rod stabilizing section 23. The increase of the width dA between the guiding bars 31 and 32 with respect to the width dB allows to reduce a degree of tensile stress rising in the receiving section and allows to reduce motion resistance of the garniture belt 15 in this section. The effect of reducing the stress is strengthened when additionally the width dB of the garniture channel 30 is greater than the width dC. It is possible to adjust the positions of the guiding bars 31 and 32, such that the widths dA and dB are equal to each other and smaller than the width dC, it means that the guiding bars 31 and 32 are located in parallel with respect to each other. Increasing the width dE between the guiding bars 39 and 40 with respect to the width dD allows to reduce the degree of the tensile stress increase in the rod stabilizing section 23 and to reduce the motion resistance of the garniture belt 15 in this section. The effect of reducing the stress is strengthened when additionally the width dD of the garniture channel 30 is smaller than the width dC. It is possible to adjust the positions of the guiding bars 39 and 40, such that the widths dD and dE are equal to each other and greater than the width dC, it means that the guiding bars 39 and 40 are located in parallel with respect to each other.

Figure 11:
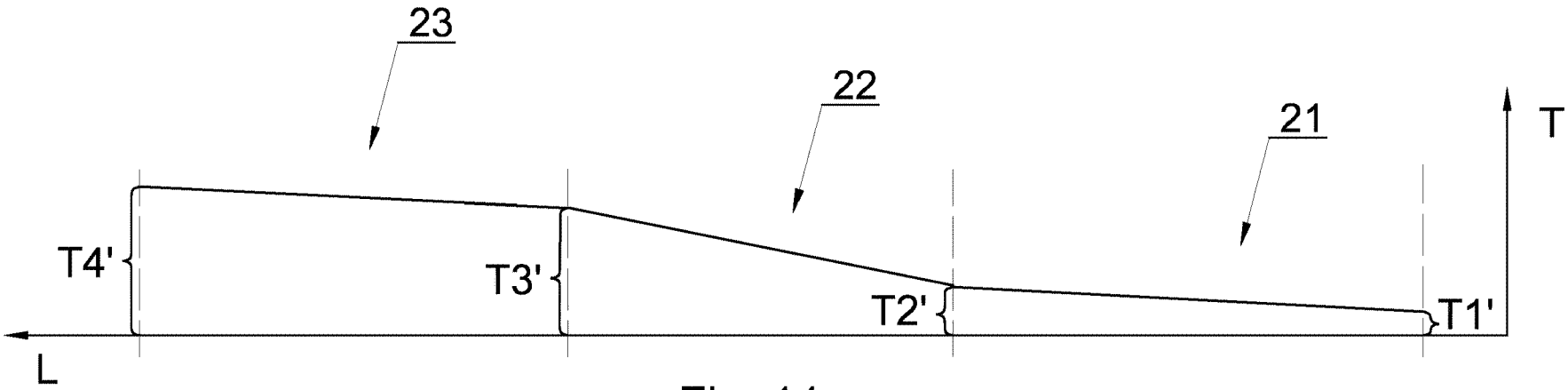

FIG. 11 shows a characteristic of the tensile stress increase in the garniture belt 15, resulting from the positions of the guiding bars, whereas this characteristic is simplified and consists of linear sections, while in reality the characteristic may be non-linear. The tensile stress T1' are in principle equal to the stress T1, while the stress T2' are smaller than the stress T2 because the guiding bars 31 and 32 are apart and the tensile stress of the garniture belt 15 are reduced. The increase of the stress from the value T2' to the value T3' is analogous to the increase of stress from the value T2 to T3. The increase of the stress from the value T3' to the value T4' is smaller than the increase of the stress from the value T3 to T4 due to the fact that guiding bars 39 and 40 are taken apart and the motion resistance of the garniture belt are reduced. The motion resistance of the garniture device is first of all related to the friction between the garniture belt and the sidewalls of the garniture channel. Owing to the change in position of the guiding bars 31, 32, 39 and 40, lower values of tensile stress T4' are achieved, which leads to a reduction of wear of the garniture belt 15 and to a reduction of the driving torque M applied to the driving wheel 24, needed to drive the garniture belt 15. The tensile stress of the garniture belt 15 may be measured directly by means of a tensile stress sensor 26A located on a rod on which the outlet roll 26 is mounted—in such case the measure of the stress is the value of the stress measured for example in $N/m^2$. A signal from the tensile stress sensor 26A may be transmitted to a controller 60. The tensile stress of the garniture belt causes elongation of the garniture belt. The elongation of the belt may be measured indirectly by means of precise encoders 18, 19 mounted on the rolls 25 and 26, wherein the signal from the encoders 18, 19 is transmitted to the controller 60. For measuring the elongation of the garniture belt a relative angular position of the outlet roll 26 and the angular position of the inlet roll 25 may be used, which is calculated by the controller on the basis of indications of the encoders and transformed into the elongation of the garniture belt. The relative position of the rolls 25 and 26 will change with respect to the wear of the garniture belt 15. In a short period of time the relative position of these rolls will not change if the garniture device operates under constant load and without interferences. The relative position of the rolls will change together with the increase of tensile stress of the garniture belt which is caused by change of operation parameters, for example change of the parameters of the filling material, for example change of its density or compressibility. On the basis of the relative change in positions of the rolls 25 and 26, the stress of the garniture belt may be calculated.

Detection of the stress which is higher than expected may be carried out in the controller 60 by comparing the signal received from the stress sensor during the operation of the machine, with the signal corresponding to the threshold value of the stress which corresponds to the maximal expected value of the stress. After detecting the stress which is higher than expected, for example when the measured value of stress exceeds the threshold value, the motion resistance of the garniture belt and in the receiving section and/or the motion resistance of the garniture belt in the rod stabilizing section is reduced. The adjustment may be performed manually or automatically by means of the driving elements adapted to change the positions of the guiding bars.

Figure 12:
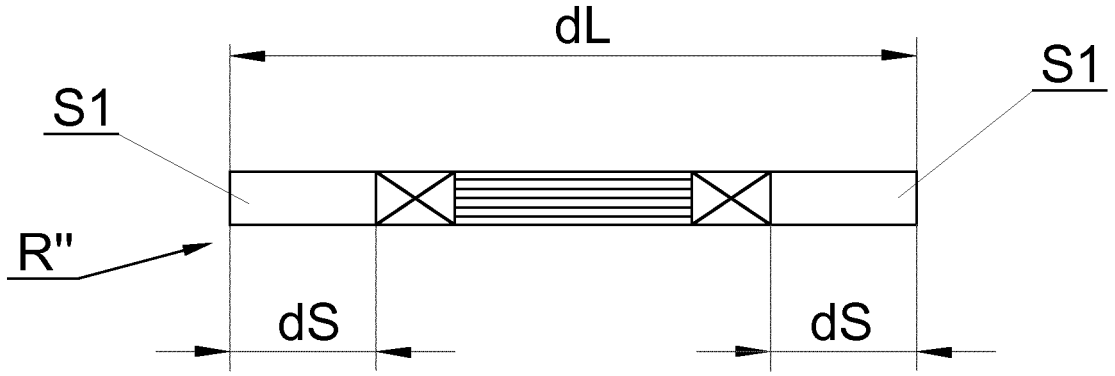
FIG. 12 shows a properly manufactured multi-segment rod.
Figure 13:
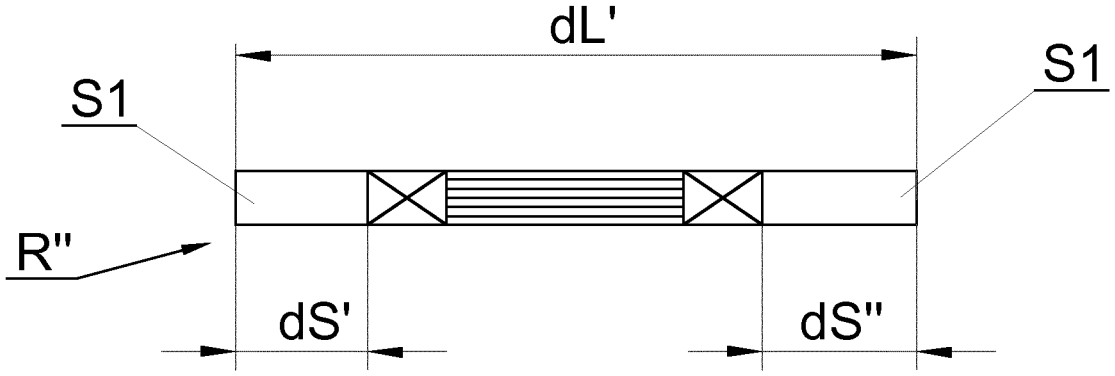
FIG. 13 shows a defective multi-segment rod.

FIG. 12 shows a properly manufactured multi-segment rod R" having a total length dL, wherein at the ends of the rod are located segments S1 and S2 having a length dS. FIG. 13 shows a defective multi-segment rod R" where its length dL' is smaller than the nominal length dL, and a length dS' is smaller than the nominal length dS, and a length dS" is bigger than the nominal length dS. During the manufacturing process, the rods having the length dL which is outside the tolerance zone, are rejected by means of the aforementioned rejection unit, moreover the rods in which the length of the end segments dS is outside the specified tolerance zone are also rejected. During tests on the machine for manufacturing rods, the tensile stress of the garniture belt 15 before and after adjustment of the guiding bars has been measured. It occurred that the reduction of the tensile stress of the garniture belt 15 as shown in FIG. 11, resulted in an unexpected decrease of a number of defective rods rejections, mainly with respect to the inappropriate length of the manufactured rods. In case of the machine for manufacturing multi-segment rods it occurred that the rejection is decreased also with respect to the inappropriate length of the segments located at the ends of the rods. This relation results from the fact that, when the segments utilized in the production differ in parameters, for example have higher diameter, the momentary increase of the stress caused by a non-stable semi-product on the garniture transporter, in which the tensile stress of the garniture belt are reduced, results in lower deviations in the lengths of the manufactured rods. This occurs due to the fact that a momentary increase of the motion resistance, and therefore the increase of the stress and associated elongation of the belt and the wrapper, causes that the length of the manufactured rods or the length of the segments in the rods will go beyond the allowable tolerance zone in a lower degree than in case when the stress of the garniture belt are maintained constantly on a high level. The momentary increase of the tensile stress will influence the elongation of the garniture belt on a shorter section than in case, when the stress of the belt arises linearly, as shown in FIG. 10. Longitudinal vibrations of the garniture belt 15, causing the momentary elongation of the wrapper have also a significant influence on the length of the manufactured rods. The longitudinal vibrations are caused by stretching of the belt and in case of the stress shown in FIG. 10 the elongation of the garniture belt under the vibrations is higher than in case of the stress shown in FIG. 11. Higher amplitude of the longitudinal vibrations of the garniture belt 15 causes, that the length of the manufactured rods in not maintained stable and moreover when additional interferences occur in the form of instability of the filling material, the length of the manufactured rods deviates in even higher degree from the expected value. The same applies to the lengths of the end segments in the manufactured multi-segment rods, which should be cut into half, but due to the abovementioned reasons, the lengths of these segments are outside the demanded tolerance zone.

In the method as presented herein it is checked in particular, what is the level of the rejections caused by the inappropriate length of the rod—for example, the measure of the level of rejections may be a percentage of the rods with inappropriate length with respect to the total amount of the manufactured rods or with respect to other rejected rods, or with respect to the amount of rejected rods in a period of time. After detecting the rejection level which exceeds the specified threshold value, the motion resistance of the garniture belt in the filling material receiving section and/or the motion resistance of the garniture belt in the rod stabilizing section are reduced.

The motion resistance in particular sections of the garniture channel have an influence on the driving torque M, which is needed to be applied to the driving wheel 24 in order to drive the garniture device 11'. Owing to the applied adjustment of the width of the garniture channel in the machine for manufacturing multi-segment rods, the driving torque on the driving roll of the garniture belt is reduced from 14 Nm to 6 Nm.

An additional effect of conducting the adjustment, causing the reduction of motion resistance of the garniture belt, is an increase of durability of the garniture belt. Reducing the tensile stress of the garniture belt clearly reduces the rate of wear of the garniture belt.

Figure 14:
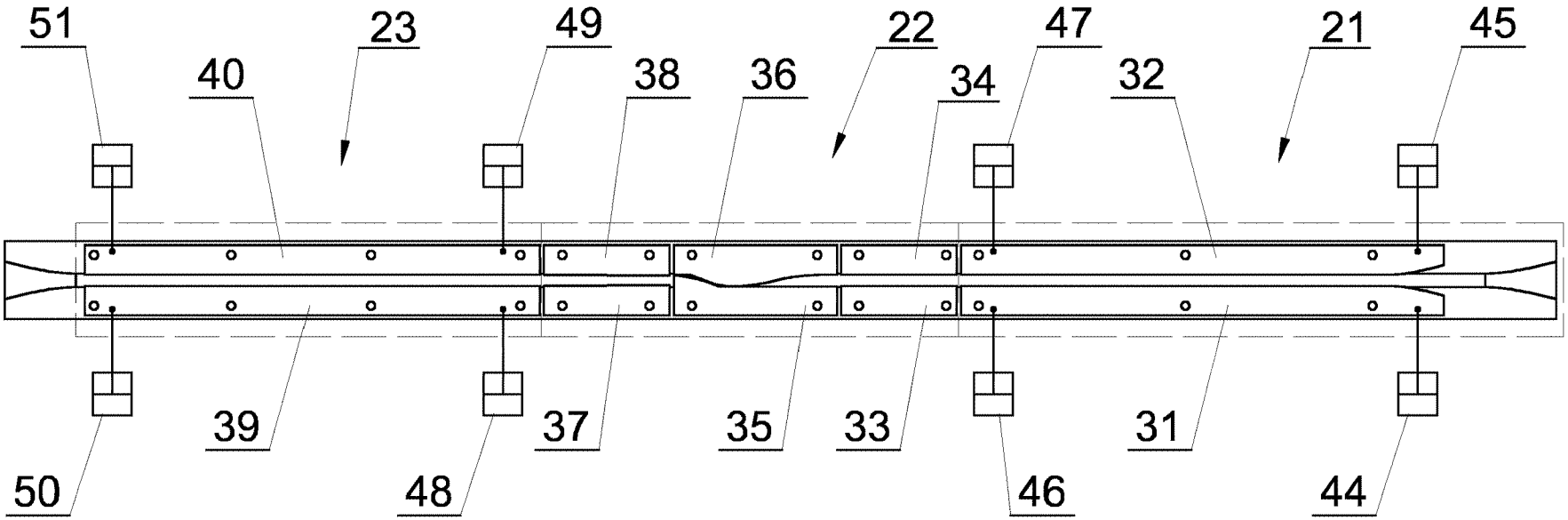
FIG. 14 shows the garniture device with driving elements for adjustment of positions of garniture bars.

FIG. 14 shows the garniture device comprising driving elements of the guiding bars. The guiding bar 31 comprises two driving elements 44 and 46, the guiding bar 32 comprises two driving elements 45 and 47. By means of the driving elements 44 and 45, located at the side of the inlet 16 the length dA may be adjusted, whereas by means of the driving elements 46 and 47, located at the side of the rod diameter setting section 22 the length dB may be adjusted. The guiding bar 39 comprises two driving elements 48 and 50, the guiding bar 40 comprises two driving elements 49 and 51. By means of the driving elements 48 and 49, located at the side of the rod diameter setting section 22, the length dD may be adjusted, whereas by means of the driving elements 50 and 51, located at the side of the outlet 17, the length dE may be adjusted. The driving elements 44, 45, 46, 47, 48, 49, 50, 51 may be an arbitrary precise linear drives. They may be mechanical drives, electrical drives, electromagnetic drives or pneumatic drives.

The invention claimed is:

1. A method for reducing stress of a garniture belt in a tobacco industry machine for manufacturing rods from a continuous rod comprising:

a. providing a garniture device, comprising:
   - a filling material receiving section; a rod diameter setting section;
   - a rod stabilizing section;
   - a garniture belt for forming the continuous rod thereon;
   - a garniture channel configured for driving the garniture belt therein;
   - guiding bars configured for guiding the garniture belt;
   - at least one driving element for changing positions of the guiding bars in a horizontal direction perpendicular to a longitudinal axis of the garniture channel to adjust a width of the garniture channel;

b. driving the garniture belt in the garniture channel;

c. forming the continuous rod on the garniture belt; and d. adjusting a resistance of motion of the garniture belt in at least one of the filling material receiving section or the rod stabilizing section by adjusting the width of the garniture channel by changing positions of the guiding bars in the horizontal direction perpendicular to the longitudinal axis of the garniture channel.

2. The method of claim 1, wherein:

a. the reducing the resistance of motion of the garniture belt in the filling material receiving section step comprises
   - adjusting positions of guiding bars in a horizontal direction so that a width of the garniture channel in the filling material receiving section is greater than a width of the garniture channel in the rod diameter setting section; and b. the reducing the resistance of motion of the garniture belt in the rod stabilizing section step comprises
   - adjusting positions of guiding bars in the horizontal direction to increase the width of the garniture channel in the rod stabilizing section as compared to the width of the garniture channel in the rod diameter setting section.

3. The method of claim 1, further comprising measuring a stress of the garniture belt and adjusting the resistance of motion of the garniture belt when the measured stress exceeds an expected stress threshold.

4. The method of claim 1, further comprising measuring a length of the manufactured rod and comparing against a pre-determined acceptable length range.

5. The method of claim 4 further comprising rejecting the rods having a length not within the pre-determined acceptable length range, assigning a rejection level, and comparing the assigned rejection level against a pre-determined acceptable rejection level.

6. The method of claim 5, further comprising adjusting the resistance of motion of the garniture belt when the rejection level exceeds the pre-determined acceptable rejection level.

7. The method of claim 1, further comprising setting the positions of the guiding bars for guiding the garniture belt in the filling material receiving section so that the guiding bars are convergent in a direction of movement of the garniture belt.

8. The method of claim 1, further comprising setting the positions of the guiding bars for guiding the garniture belt in the filling material receiving section (21) so that the guiding bars are in parallel with respect to each other.

9. The method of claim 1, further comprising setting the positions of the guiding bars for guiding the garniture belt in the rod stabilizing section so that the guiding bars are divergent in a direction of movement of the garniture belt.

10. The method of claim 1, further comprising setting the positions of the guiding bars for guiding the garniture belt in the rod stabilizing section so that the guiding bars are in parallel with respect to each other.

11. The method of claim 1, wherein the filling material is a filtering material.

12. The method of claim 1, wherein the filling material has a form of segments.

13. The method of claim 1, wherein the filling material has a form of segments and of a loose material.

14. The method of claim 1, wherein the filling material is a tobacco material.

15. A garniture device for a tobacco industry machine for manufacturing rods from a continuous rod comprising:

a. a filling material receiving section;

b. a rod diameter setting section;

c. a rod stabilizing section;

d. a garniture belt for forming the continuous rod thereon;

e. a garniture channel configured for driving the garniture belt therein;

f. guiding bars configured for guiding the garniture belt; and g. at least one driving element for changing positions of the guiding bars in at least one of the filling material receiving section or the rod stabilizing section in a horizontal direction perpendicular to a longitudinal axis of the garniture channel to adjust a width of the garniture channel.

16. The device of claim 15, wherein the driving element is a mechanical device.

17. The device of claim 15, further comprising a tensile stress sensor disposed on the roll for detecting stress of the garniture belt.

18. The device of claim 15, further comprising an inlet roll disposed at a first end of the filling material receiving section for guiding the garniture belt, an outlet roll disposed at a second end of the stabilizing section along the garniture channel, and a driving wheel for driving the garniture belt from the inlet roll towards the outlet roll.

19. A tobacco industry machine for manufacturing rods from a continuous rod comprising:

a. a garniture device, comprising a filling material receiving section;

a rod diameter setting section;

a rod stabilizing section;

a garniture belt for forming the continuous rod thereon;

a garniture channel configured for driving the garniture belt therein;

guiding bars configured for guiding the garniture belt; and at least one driving element in at least one of the filling material receiving section or the rod stabilizing section for changing positions of the guiding bars in a horizontal direction perpendicular to a longitudinal axis of the garniture channel to adjust a width of the garniture channel;

b. at least one feeding unit for feeding a filling material onto a wrapper which is transported on the garniture belt;

c. a glue feeding unit for feeding glue on the edge of the wrapper; and d. a cutting head for cutting the continuous rod into rods.

* * * * *